US006285838B1

(12) United States Patent
Able et al.

(10) Patent No.: US 6,285,838 B1
(45) Date of Patent: Sep. 4, 2001

(54) BELT FUSER OVERHEAT CONTROL

(75) Inventors: Douglas Anthony Able, Shelbyville; Brian Keith Bartley, Burgin; Steven Alan Curry, Nicholasville, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/654,579

(22) Filed: Sep. 1, 2000

(51) Int. Cl.[7] ..... G03G 15/20
(52) U.S. Cl. ..... 399/45; 399/68
(58) Field of Search ..... 399/45, 67, 68

(56) References Cited

U.S. PATENT DOCUMENTS

| | | |
|---|---|---|
| 4,549,803 | 10/1985 | Ohno et al. . |
| 4,595,279 | 6/1986 | Kuru et al. . |
| 4,634,262 | 1/1987 | Imaizumi et al. . |
| 4,825,242 | 4/1989 | Elter . |
| 5,170,215 | 12/1992 | Pfeuffer . |
| 5,289,247 | 2/1994 | Takano et al. . |
| 5,325,166 | 6/1994 | Hamilton et al. . |
| 5,436,709 | 7/1995 | Sakaizawa et al. . |
| 5,552,874 | 9/1996 | Ohtsuka et al. . |
| 5,563,696 | 10/1996 | Futagawa et al. . |
| 5,568,229 | 10/1996 | Szlucha . |
| 5,669,039 | 9/1997 | Ohtsuka et al. . |
| 5,689,760 | 11/1997 | Suzuki et al. . |
| 5,860,051 | 1/1999 | Goto et al. . |
| 5,978,612 | 11/1999 | Suzuki et al. . |

*Primary Examiner*—Joan Pendegrass
(74) *Attorney, Agent, or Firm*—John A. Brady

(57) ABSTRACT

To protect a belt fuser (20) a weighted value for sheets being fused is assigned which is larger for smaller widths and larger for longer length. For standard width media a negative value is assigned. A first count is maintained until it reaches a first threshold, after which (operations 76 and 86), the printer is slowed to half speed, twice interpage gap interval and lower fuser temperature. A subsequent count is made of a second set of weighted values (action 62). In response to the second count the interpage gap interval is increased depending on the size of the count and the nature of the media. For example (Table 1), narrow and long media is fed 2 sheets at 30 ppm, then 3 sheets at 15 ppm by slowdown, then 5 sheets at 9 ppm by increasing the gap interval during slowdown and the remainder of such sheets are fed at 5 ppm by further increasing the gap interval. Very short envelopes and paper are fed 10 sheets at 10 ppm and the rest at 15 ppm by the slowdown. As count 1 is reduced, it must be at an intermediate value before ending the slowdown, which avoids excess switching between full speed and half speed. This operates the belt fuser at temperatures avoiding damage from narrow media while throughput is good.

16 Claims, 5 Drawing Sheets

START
50
RECEIVE PRINT REQUEST FROM RIP
52
HAVE LENGTH / WIDTH INFO. FOR THIS SOURCE
54
YES
NO
ASSIGN LENGTH/WIDTH INFO. FROM RIP INFO. ABOUT SOURCE
56
STORE THIS WIDTH/LENGTH INFO. FOR COMPARISON
58
THROUGHPUT DECREASED BY TRANSPORT SLOWDOWN
60
NO
YES
ADD PAGE WEIGHT TO CT 2
62
CT2 ≥ CT2 THRESHOLD
64
YES
CT2=CT THRESHOLD
66
NO
CT2 < 0
68
YES
CT2=0
70
NO

BELT FUSER OVERHEAT CONTROL

TECHNICAL FIELD

This invention relates to imaging apparatus employing heaters, specifically heaters having belt-fuser characteristics, to fix a toned image to paper or other substrate. More specifically, this invention relates to maintaining high throughput while protecting such apparatus from overheating when the substrate is narrow.

BACKGROUND OF THE INVENTION

U.S. Pat. No. 5,325,166 to Hamilton et al. teaches assigning weighted values to sheets of different characteristics specifically the values of −7 for full size sheets, +13 for narrower sheets such as A5, and +17 for envelopes. These weighted values are accumulated as a count. When the count reaches a predetermined value, the time interval between subsequent sheets is increased. Subsequent feeding of full size sheets reduces the count to a second predetermined value at which normal throughput is resumed, although the second predetermined value is more than zero, so reduced throughput may be again resumed from feeding less sheets through from a cold condition.

The implementation of the foregoing patent was directed to nip fusers, which employ two rollers in nip relation through which the sheet passes for fusing. A belt fuser employs a thin belt wrapped over a ceramic or other low-thermal-capacity heater. A representative belt fuser is disclosed in U.S. Pat. No. 5,860,051 to Goto et al. The thin belt of a belt fuser is highly susceptible to damage from fusing sheets which extend only partly across the width of the belt, i.e., narrow media. The differential in heat across the belt is the source of overheat damage. Conversely, a belt fuser recovers more quickly from the differential in heat when no sheet is in the fuser, such as during the interpage time interval. This is particularly true where the heater is not powered during some of that time interval. The term "belt fuser characteristics" refers to a fuser having low thermal capacity, preferably one, which is routinely not powered during part of interpage time intervals.

To maintain good throughput (number of sheets per unit of time) while protecting the fuser, both width and length are determined and employed as described below.

DISCLOSURE OF THE INVENTION

Both a width category and a length category of sheets being sent to the fuser are determined. A weighted value for each sheet is assigned which is larger for smaller widths and larger for longer lengths. For standard width media, a weighted value is assigned which is opposited in sense (i.e., narrow media assigned plus weighted values, wide media assigned minus weighted values). As sheets are fed these weighted values are accumulated in a first count.

Upon the first count reaching a predetermined plus value, media speed is reduced, fuser temperature is reduced and the intermedia time interval is reduced. Also, upon the first count reaching the predetermined value, a second count of weighted values of sheets fed is begun. The weighted values usually will be different from the weighted values used in the first count, but will be in the same sense and in similar proportion to one another. At certain predetermined values of the second count, depending on the type of media, the interval between sheets is increased. In an embodiment, narrow but short media is not additionally delayed, while narrow but somewhat longer media is delayed from 15 ppm to 9 ppm, while more stressful media is delayed at one value of the second count from 15 ppm to 7 ppm and at a higher value of the second count from 7 ppm to 6 ppm.

Both the first count and the second count do not rise after reaching their predetermined value for the last feeding action as described. When the second count is reduced by the feeding of a standard sheet, the first count is reduced with it to an intermediate, predetermined value so as to avoid frequent oscillations between full speed and half speed.

Various media types given different weighting and feeding categories are paper, envelopes and labels. Labels are typically very thick, at least when they have a layer over an adhesive surface

BRIEF DESCRIPTION OF THE DRAWING

The details of this invention will be described in connection with the accompanying drawings in which.

DESCRIPTION OF THE PREFERRED EMBODIMENT

Figure 1:
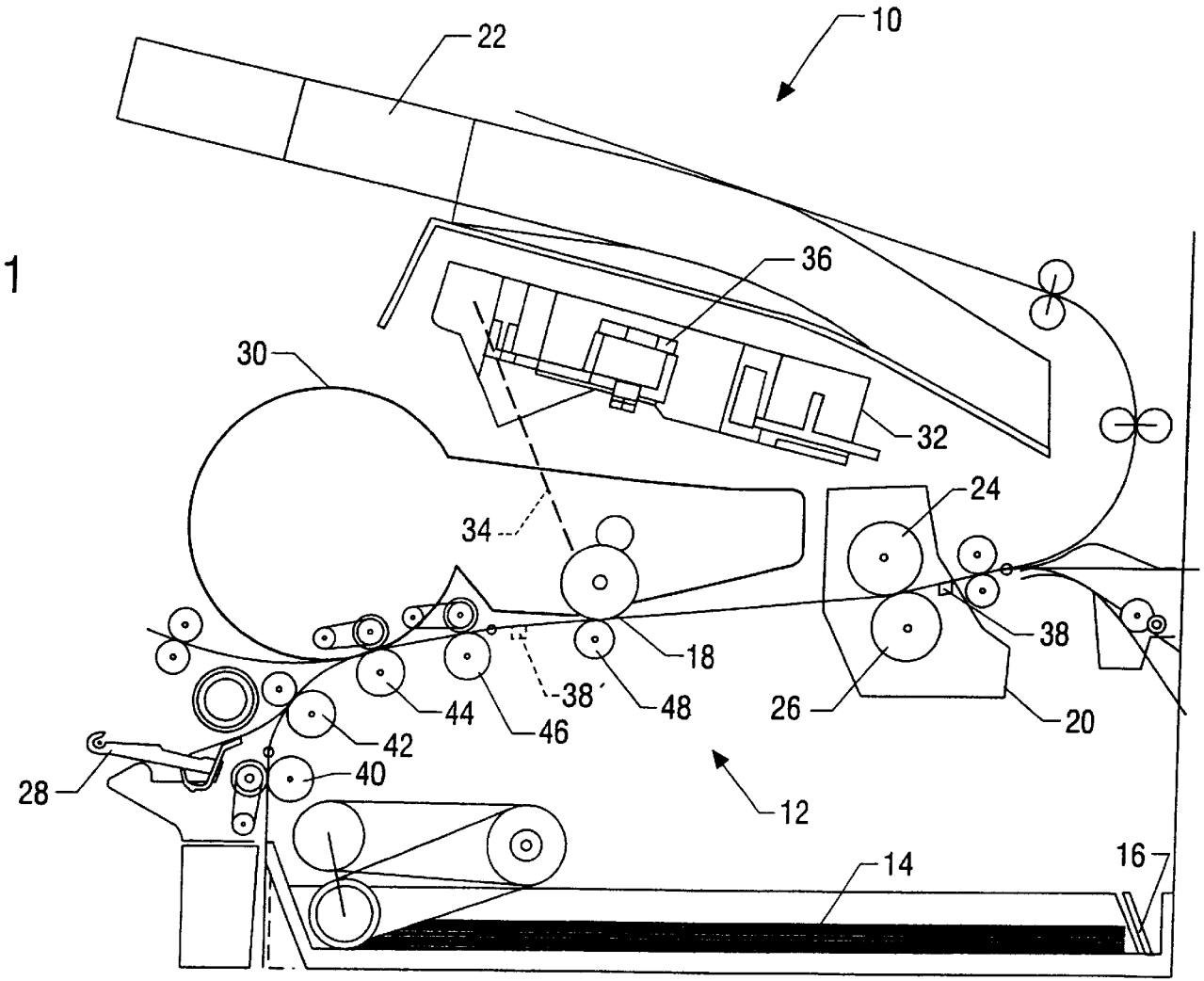
FIG. 1 is illustrative of a printer or other imaging device having a fusing operation in accordance with this invention.

Referring to FIG. 1, an electrophotographic printer 10 includes a media feed path 12 for feeding sheets of media 14, such as paper, from a media tray 16 past a photoconductive drum 18 and a fuser assembly 20 to an output tray 22. The fuser 20 is a belt fuser formed by a belt assembly 24, which is heated to a relatively high temperature to fuse particles of toner to the sheets for media 14, and a backup roller 26. U.S. Pat. No. 5,860,051 to Goto et al. is illustrative of a belt fuser. In this belt fuser a polyamide belt passes over a ceramic heater. Special media, such as envelopes and labels, are fed into the media feed path 12 from an external, front-option tray 28, sometimes referred to as a multi-purpose tray. Special media may also be fed from a separate, external tray (not shown). The photoconductive drum 18 forms an integral part of a replaceable toner cartridge 30 inserted in the printer 10. A printhead 32 is disposed in the printer 10 for scanning the photoconductive drum 18 with a laser beam 34 so that it ultimately sweeps or "scans" across a "writing line" on the photoconductive drum 18, thereby creating, in a black and white laser printer, a raster line of either black or white print elements, also known as "pels". The polygonal mirror 36 typically has six or eight facets, and each one-sixth or one-eighth rotation of the polygonal mirror 36, respectively, creates an entire swept raster scan of laser light that ultimately becomes a writing line on a sheet of media 14. The operation of the printhead 32 is more fully described in U.S. Pat. No. 5,877,798 to Clarke et al., also assigned to the assignee of the present application.

In the illustrated embodiment, the printer 10 has a narrow media sensor 38 located downstream, as viewed from the direction of flow of the media 14, from the photoconductive drum 18 and the fuser assembly 20. The narrow media sensor 38 detects the presence of sheets of narrow media in the media feed path 12. The narrow media sensor 38 could alternatively be located upstream from the photoconductive drum 18, as indicated in phantom 38'. A plurality of rollers 40, 42, 44, 46, 48 function in a known manner to transfer the sheets of media 14 from the media tray 16 or multi-purpose tray 28 through the media feed path 12.

Preferably to carry out this invention, the paper path 12 contains a front edge sensor by which the length of media is sensed. Such length sensing is conventional. In accordance with this invention the sensing of the length may be at any point in the paper path 14.

Other sources of information as to media type are the print data, which typically identifies in some way the media, as by a direct identification or by specifying a given media source. Separate from the print data, if the media source has size sensing which is an existing capability, then the size is known. If the media source specifies media from a tray known to be an envelope tray or label tray, that information about the media becomes known.

In this embodiment, at initiation when no length measurement is available, the controlling source of information employed is information from and about the media unique to the media source. If that is insufficient, an operator entry in the control panel, if one, is employed. If that is insufficient, the information in the print data is relied on. (Commonly, the print data always specifies information about the media, although it may be incorrect because of the actual media loaded, as by human operators, in the media source.) When a media is fed, in this embodiment it is measured longitudinally and measured for width being narrow. That information is stored as the content of the source (tray, manual feeder, and the like) from which it came. Subsequently, that infonnation is the controlling source of information.

Except for use of length measurement in this invention, the foregoing priority as to controlling source of media information is not novel with respect to this invention.

An illustrative prior system of fuser overheat control differing from this invention in relevant respects, by use in this invention of media length and the manner of use of media information, is U.S. patent application Ser. No. 09/590,574, filed Jun. 8, 2000, by Able et al. As in that description, this embodiment has a side edge reference where media feeds through fuser 20. Side edge reference increases overheat tendency over center reference as the damage results from differential in heating between the part of fuser 20 containing media and the part of fuser not contacting media.

Reference is made to FIG. 2, showing system operation in accordance with this invention. Action 50 starts when the printer is turned on from off. Action 52 then occurs when the raster image processor (abbreviated RIP) has created a page of data, as is conventional, and requests that it be printed.

To initiate printing, the printer controller first determines decision 54, is length and width information known for the source. This is not known if the source has not first been used and if the source does not identify that information. If no, action 56 assigns width and length information based on what RIP knows about the source. If action 56 is taken, the width and length information is stored for later comparison by action 58.

When the length and width is determined by decision 54 being yes or by action 56, decision 60 is made to determine if the printer is currently operating at slow speed (specifically in the embodiment one-half speed). If yes, then in action 62 the page weight is added to count 2 (CT 2). In decision 64 count 2 is compared to its predetermined threshold (maximum value). If greater, action 66 is taken which reduces count 2 to that maximum value. If decision 64 is no, count 2 is examined by decision 68 for being less than zero, and, if less than zero, count 2 is set to zero by action 70.

When decision 60 is no, the next step is action 72, in which the page weight is added to count 1 (CT 1). Action 72 is also reached when actions 66 and 70 are taken and when decision 68 is no.

After action 72, in decision 74 count 1 is compared to its predetermined threshold (maximum value). If greater (yes), decision 75 checks to see if the transport has already been slowed down. If decision 75 is no, action 76 sets a bit in electronic memory to indicate transport slowdown. Transport slowdown is effected by reducing transport speed (to one-half speed in the embodiment), reducing fuser temperature (to compensate for the longer residence time in the fuser), and increasing the interval between initiating sheet feeds (to twice normal interval in the embodiment). Also, when decision 75 is no, count 2 is reset to zero in action 78, and count 1 is set to its maximum value in action 80. Action 80 is also reached when decision 75 is yes.

When action 74 is no, decision 82 determines if count 1 is equal to or less than a predetermined lower threshold. The lower threshold is a predetermined intermediate value (in the embodiment one-third less than the maximum threshold) used to prevent frequent swings from full speed to reduced speed. If decision 82 is no, the next operation is decision 86, which is to effectuate slowdown if the bit set by action 76 is set and if one of a set of conditions discussed below is satisfied.

If decision 82 is yes, the slowdown bit set by action 76 is cleared by action 83. Also, in decision 84, count 1 is examined for being less than zero, and if less than zero, count 1 is set to zero in action 85, which resets the counter to zero, its cold-start status. Decision 86 is also reached by decision 84 being no and by action 85 being taken.

When decision 86 is no, the system is not slowed, and count 1 is considered the controlling count, as indicated by action 87. With count 1 controlling, the interpage gap (interval between feeding sheets) is that for standard printing. When decision 86 is yes, in action 88 the interpage gap is selected based on count 2. Completion of action 86 or action 88 initiates printing, action 90.

During printing, action 92, the sheet (page) being printed passes a front edge sensor and the length of that page is measured in action 94. In decision 96, based on sensing of the leading edge of the page, a decision is made whether the leading edge of the page is past the narrow sensor. If decision 96 is yes, the decision 98 is taken determining whether the narrow media (NM) sensor was made. If not made, the media is deemed narrow.

If decision 96 is no, then decision 100 is taken, determining if the trailing edge of the page is at the nip of fuser 20, since in this particular embodiment, the front edge sensor is located just prior to the page clearing the narrow media sensor. If decision 100 is no, then decision 100 is repeated. When decision 100 is yes, decision 98 is taken.

If decision 98 is yes, in action 102 infonnation is stored marking the page as narrow. (The source of that page is deemed to store sheets of the marked information at the next feed from that source.)

When decision 98 is no or when action 102 is taken, action 104 uses the measurement information and information from the RIP, as well as any infonnation input by the operator, to designate the current page as nearly narrow, envelope or label. (Nearly narrow is a known designation by which sheets wider than the narrow media sensor are designated stressful to the fuser. In addition to print data information in the RIP, a typical source to identify nearly narrow to the RIP is a control panel entry by a human operator.)

Then, in decision 106, the resulting length and width information is compared with the information stored in action 58, which is the information used when the current print request was processed, beginning with action 52. If no, the infonnation is different and action 108 removes the page weight added to count 1 and count 2. In action 110, the new (corrected) weight based on the actual measurement, is accumulated in count 1 and count 2. Also, in action 112 which is also reached when decision 106 is yes, the correct information is stored so that action 54 will subsequently recognize the action 112 data as the controlling data for that source and will then determine yes for that source.

When decision 106 is yes or when action 112 is taken, the narrow media response for this page is ended in action 114.

Table 1 best illustrates the desired response changing based on the count 1 and count 2 information.

TABLE 1

| Media Type/Length | | | | Pages Throughput | | | | | |
|---|---|---|---|---|---|---|---|---|---|
| Profile | Paper/Other | Envelope | Label | 30 ppm | 15 ppm | 9 ppm | 7 ppm | 6 ppm | 5 ppm |
| 1 | >310 | >310 | >221 | 2 | 3 | 5 | 0 | 0 | Rest |
| 2 | 269–310 | 250–310 | 160–221 | 3 | 5 | 7 | 0 | Rest | |
| 3 | 221–269 | 210–250 | | 3 | 6 | 9 | Rest | | |
| 4 | 140–221 | 140–210 | <160 | 6 | 10 | Rest | | | |
| 5 | <140 | <140 | | 10 | Rest | | | | |

As shown in Table 1 media is categorized for response as envelope, label, and other ("other" includes ordinary paper). Each category of media is further classified into 3 lengths ranges (for labels) or five length ranges (for envelope and other). The lengths in Table 1 are in millimeters (mm). Thus, the shortest range for envelopes and other is profile 5, which is less than 140 mm. The longest range for envelopes and other is greater than 310 mm. For labels the shortest ranges is less than 160 mm and the longest range is greater than 221 mm. Those and the intermediate ranges are shown in Table 1.

The five, numbered profiles in Table 1 relate the categories, shown in the middle under "Media Type/Length", to the throughput actions, shown on the right under "Pages Throughput". The embodiment has a standard throughput of 30 pages per minute (ppm). The number of media fed at 30 ppm causing counter 1 to reach its maximum threshold is, as shown in Table 1, 2 for profile 1, 3 for profile 2, 3 for profile 3, 6 for profile 4 and 10 for profile 5. This is implemented by decision 74 and action 76 of FIG. 2B not slowing down the speed until the 2 to 10 media sheets have been fed, depending on the profile of the current sheet.

After the foregoing printing at rated speed, decision 86 is yes and, the slowdown is effected. The next column is the resulting throughput, which is one-half or 15 ppm. Decision 60 is yes for the next sheet, so count 2 begins to be accumulated. The number of sheets for each profile is 3 for profile 1, 5 for profile 2, 6 for profile 3, 10 for profile 4 and unlimited (the rest of the sheets) for profile 5, which is envelope and paper which is narrow but short.

The next action is to further increase the time interval between sheets (the interpage gap). The first action to effect this is shown in the column headed 9 ppm. Lengthening the interpage gap allows for both cooling and evening of temperature across the fusing device.

For Profile 1, 5 sheets of profile 1 are fed at 9 ppm; for profile 2, 7 sheets are fed at 9 ppm; for profile 3, 9 sheets are fed at 9 ppm; and for profile 4, unlimited sheets are fed. Subsequently, after the 9 sheets for profile 3, an unlimited number of profile 3 sheets are fed at 7 ppm. After the 7 sheets for profile 2, an unlimited number of sheets are fed at 6 ppms and after the 5 sheets for profile 1, an unlimited number of sheets are fed at 5 ppm.

Further illustrations of this are the following three examples:

Example 1: Letter length narrow paper
- Letter length=279.4mm
- In Paper/Other column, 279.4mm corresponds to profile 2
- 3 pages at 30ppm, 5 at 15ppm, 7 at 9ppm, rest at 6ppm Example 2: Letter length narrow label
- Letter length=279.4mm
- In label column, 279.4mm corresponds to profile 1
- 2 pages at 30ppm, 3 at 15ppm, 5 at 9ppm, rest at 5ppm Example 3: A5 paper
- A5 length=210mm
- In Paper/Other column, 210mm corresponds to profile 4
- 6 pages at 30ppm, 10 at 15ppm, rest at 9ppm The response of Table 1 is achieved by assigning weighted value to the sheets with respect to count 1 so as to achieve outputs in accordance with Table 1. The numbers in the columns of Table 1 represent the number of pages to be printed at the stated rate. Since the sheet being fed could cause count 1 to exceed its threshold, the weighted values for count 1 are calculated based on the number of sheets given in the table plus one. Since the page counts in the 30 ppm column for profiles 1 through 5 are 2, 3, 3, 6, 10. The values 3, 4, 4, 7, and 11 are used to calculate the weights. Therefore, with respect to count 1, sheets in profile 1 may be assigned a weighted value of 1, while those in profiles 2 and 3 are assigned a weighted value of $\frac{3}{4}$, those in profile 4 being assigned $\frac{3}{7}$and those in profile 5 being assigned $\frac{3}{11}$. Since these will be processed by electronic data processing, an integer form is desired, and is readily done by multiplying by the least common denominator, 308, giving a weighted value of 308, 231, 132, 84 respectively, and a maximum threshold of count is 1 of 924 (308×3 or 231×4 or 132×7 or 84×11 and also any combination of sheets which accumulate to 924). Accordingly, the lower threshold of count 1 to which decision 82 reacts is 616, which is $\frac{2}{3}$of 924.

With respect to count 2, since the counting of sheets will not result in crossing the count 1 threshold, the progressive count values used to calculate the weights are approximated in each profile by the total pages until unlimited feeding, which are 8 (3 plus 5), 12 (5 plus 7), 15 (6 plus 9) and 10. So, assigning a weight of 1 to sheets in profile 1; sheets in profile 2 are assigned a weighted value of $\frac{2}{3}$; sheets in profile 3 are assigned a weighted value of $\frac{8}{15}$; sheets in profile 4 are assigned a weighted value of $\frac{4}{5}$. Multiplying by the least common denominator of 30 results in the weighted values of 30, 20, 16 and 24 for profiles 1, 2, 3, and 4 respectively. A maximum threshold of count 2 is 240 (30×8 or 20×12 or 16×15 or 24×10 and also any combination of sheets which accumulate to 240).

Typically 15 standard media (8 ½×11 inches) are sufficient to permit subsequent standard feed after count 2 is at its maximum threshold of 240. The count weighted value of standard media to contribute to crossing the fast/slow threshold therefore is −15 (240÷16).

Figure 2A:
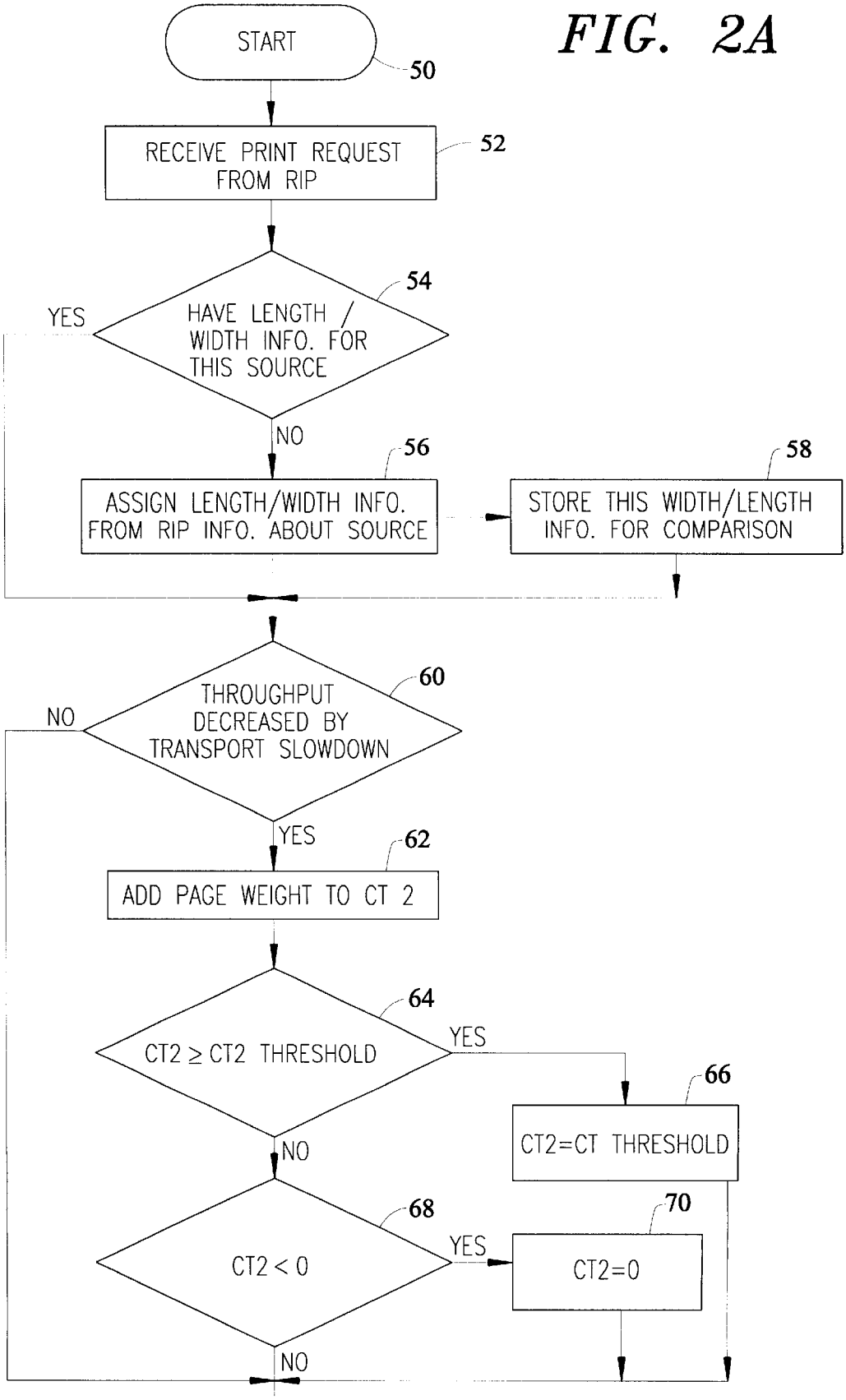
FIGS. 2A–2D are a flow diagram of the operation of this invention.
Figure 2B:
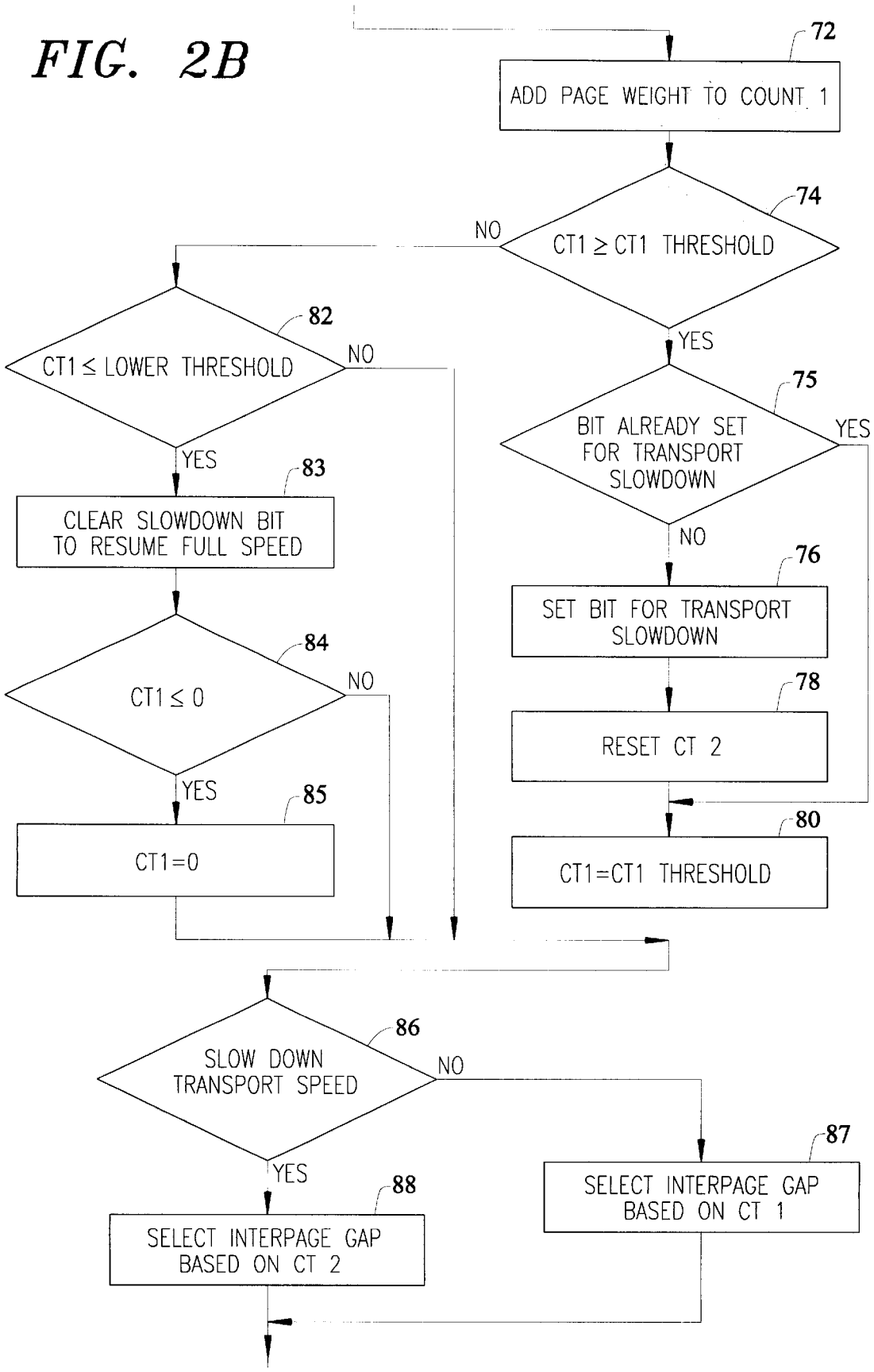
Figure 2C:
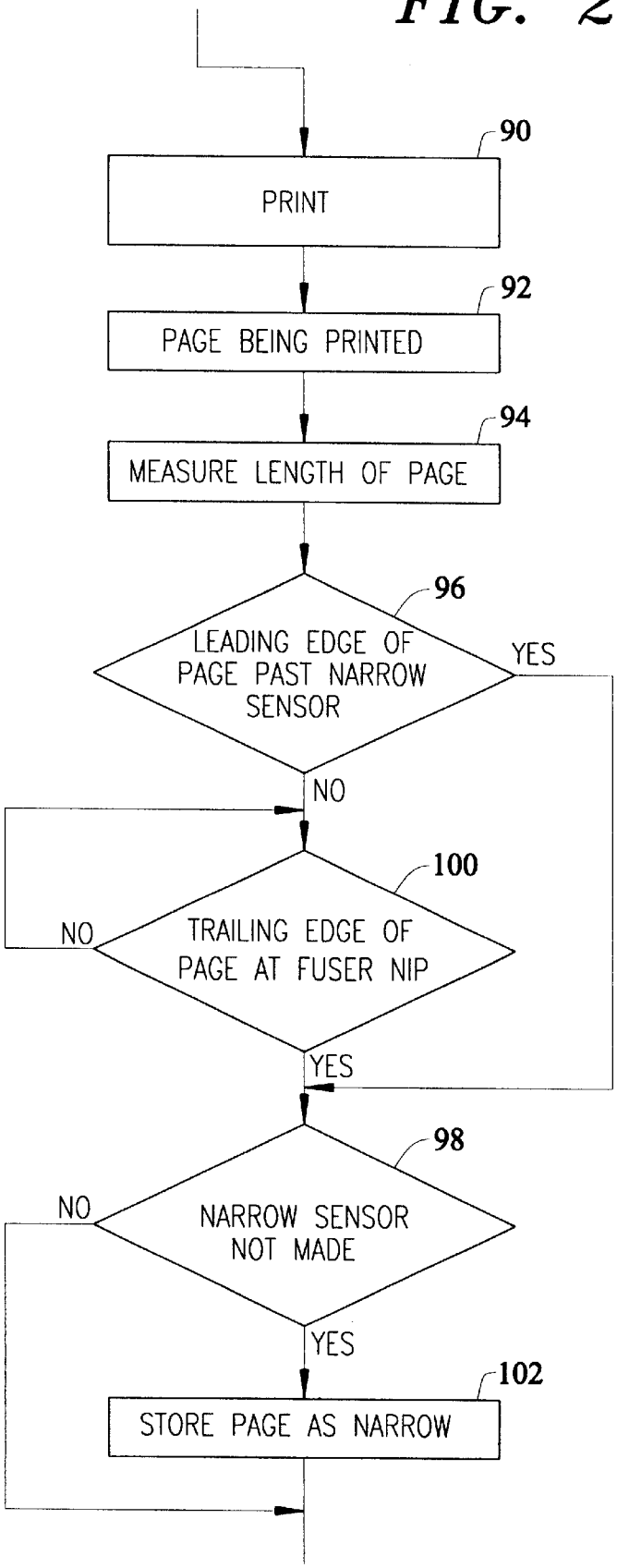
Figure 2D:
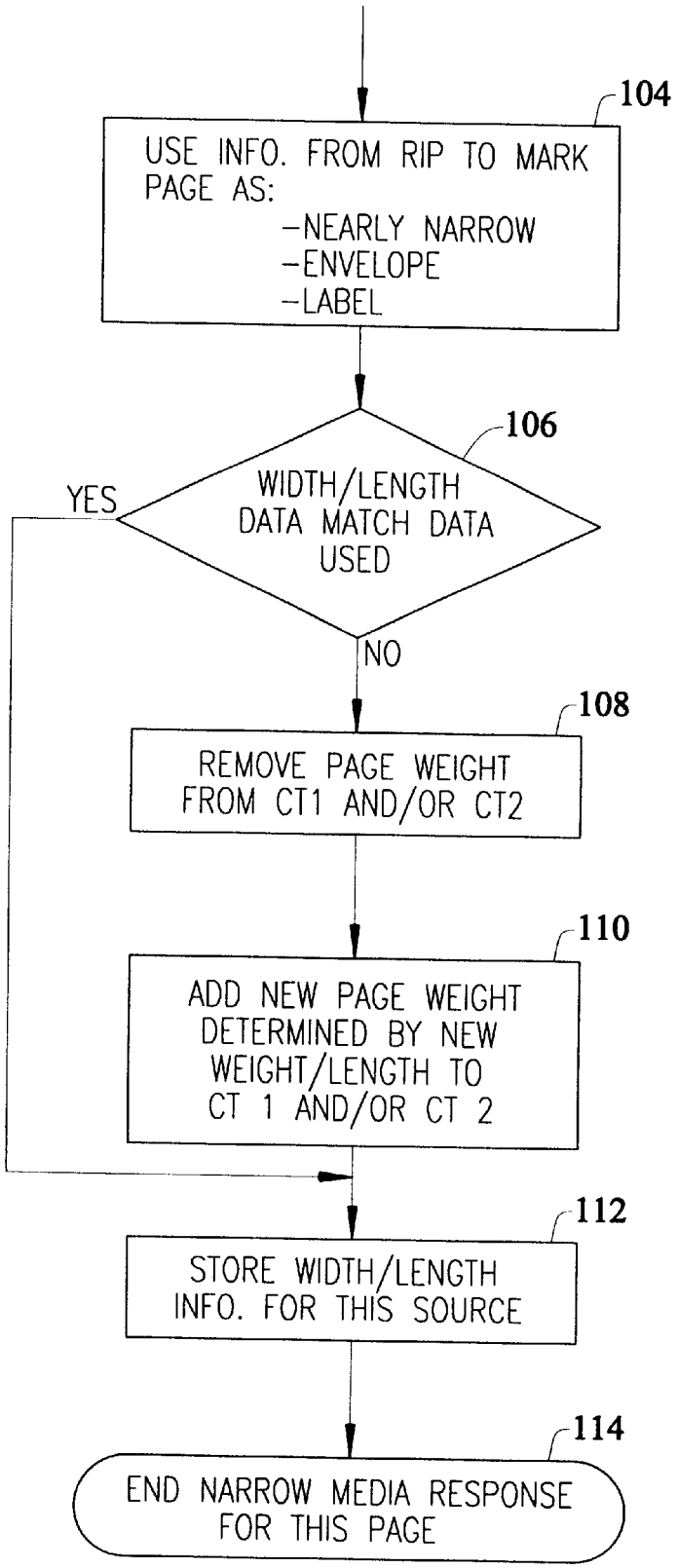

Count 1 weighted value of standard media is determined experimentally. A typical value is −19. As FIGS. 2A–2B show, count 1 is reduced while count 2 is also being maintained. Count 1 reaches the lower threshold after 15 consecutive standard sheets, each weighted −19, thereby resulting in decision 82 being yes. While count 2 is active, −15 is entered into count 2 for standard media.

All of the foregoing control actions and computations of FIG. 2 and Table 1 are done by an electronic data processor, which typically is a microprocessor (or microprocessors; typically the RIP is done by a separate microprocessor). Such accumulating and electronic control of a printer is standard. Increasing the interpage gap is a simple change of when the sheet is picked from its source based on the overall timing controlled by the microprocessor.

It will be appreciated that specific values given are illustrative with regard to the limits of this invention. Since successful operation involves interaction of both heating and cooling of elements which may vary in characteristics, final values are obtained experimentally and will vary depending on all the physical factors of a particular imaging device.

Alternatives and variations will be apparent and can be expected.

What is claimed is:

1. A method of improving throughput of media having images fixed by a heat fixing device comprising:

assigning weighted values to media being fixed by said fixing device, said values being larger for smaller widths of media and larger for longer lengths of said media, and include a negative for wider media, accumulating weighted values for successive media being fixed by said fixing device as a first count, slowing the movement of media through said fixing device, reducing the temperature of fixing of said fixing device and increasing the time interval between sheets when said first count reaches a predetermined value, accumulating weighted values for subsequent successive media being fixed by said fixing device as a second count, and while continuing slow movement of media through said fixing device and reduced temperature of fixing of said fixing device further increasing the time interval between sheets reaching said fixing device to a first time interval when said second count reaches a first predetermined value.

2. The method as in claim 1 in which said further increasing the time interval is done for paper and envelopes 140 mm or greater in length and is not done for paper and envelopes less than 140 mm in length.

3. The method as in claim 1 in which said weighted values assigned are different amounts for similar widths to each of envelope; labels and paper and different amounts for similar length to each of envelopes, labels and paper.

4. The method as in claim 3 also comprising:

while continuing slow movement of media through said fixing device and reduced temperature of fixing of said fixing device, increasing said first time interval to a second time interval longer than said first time interval when said second count reaches a second predetermined value larger than said first predetermined value.

5. The method as in claim 1 in which when said second count is reduced to a predetermined low value, said first count is reduced to an intermediate value, whereby frequent change between full speed and said slow speed is avoided.

6. The method as in claim 2 in which when said second count is reduced to a predetermined low value, said first count is reduced to an intermediate value, whereby frequent change between full speed and said slow speed is avoided.

7. The method as in claim 3 in which when said second count is reduced to a predetermined low value, said first count is reduced to an intermediate value, whereby frequent change between full speed and said slow speed is avoided.

8. The method as in claim 4 in which when said second count is reduced to a predetermined low value, said first count is reduced to an intermediate value, whereby frequent change between full speed and said slow speed is avoided.

9. An imaging device having a fixing system having belt fuser characteristics operative as described in claim 1.

10. An imaging device having a fixing system having belt fuser characteristics operative as described in claim 2.

11. An imaging device having a fixing system having belt fuser characteristics operative as described in claim 3.

12. An imaging device having a fixing system having belt fuser characteristics operative as described in claim 4.

13. An imaging device having a fixing system having belt fuser characteristics operative as described in claim 5.

14. An imaging device having a fixing system having belt fuser characteristics operative as described in claim 6.

15. An imaging device having a fixing system having belt fuser characteristics operative as described in claim 7.

16. An imaging device having a fixing system having belt fuser characteristics operative as described in claim 8.

* * * * *